US007936323B2

(12) United States Patent
Mori et al.

(10) Patent No.: US 7,936,323 B2
(45) Date of Patent: May 3, 2011

(54) LIQUID CRYSTAL DISPLAY DEVICE

(75) Inventors: Ikuko Mori, Chiba (JP); Kikuo Ono, Mobara (JP)

(73) Assignee: Hitachi Displays, Ltd., Tokyo (JP)

( * ) Notice: Subject to any disclaimer, the term of this patent is extended or adjusted under 35 U.S.C. 154(b) by 914 days.

(21) Appl. No.: 11/896,366

(22) Filed: Aug. 31, 2007

(65) Prior Publication Data

US 2008/0068516 A1 Mar. 20, 2008

(30) Foreign Application Priority Data

Sep. 15, 2006 (JP) ..... 2006-250989

(51) Int. Cl.
*G09G 3/36* (2006.01)

(52) U.S. Cl. ..... 345/87; 345/89; 345/92; 349/106

(58) Field of Classification Search ..... 345/87, 345/89, 92, 96; 349/106, 110
See application file for complete search history.

(56) References Cited

U.S. PATENT DOCUMENTS 6,075,505 A * 6/2000 Shiba et al. ..... 345/87
6,075,507 A * 6/2000 Miyahara et al. ..... 345/89
6,552,707 B1 4/2003 Fujiyoshi
6,707,441 B1 * 3/2004 Hebiguchi et al. ..... 345/92
7,102,707 B2 * 9/2006 Fujimaki et al. ..... 349/106
7,420,533 B2 * 9/2008 Yun ..... 345/96
2002/0186191 A1 * 12/2002 Ikeda et al. ..... 345/87
2003/0071773 A1 * 4/2003 Ohtani et al. ..... 345/87
2005/0007525 A1 * 1/2005 Jun et al. ..... 349/110
2005/0146656 A1 * 7/2005 Mima ..... 349/110
2008/0117149 A1 * 5/2008 Hashimoto et al. ..... 345/87

FOREIGN PATENT DOCUMENTS

JP 11-326869 11/1999

* cited by examiner

*Primary Examiner* — Amare Mengistu
*Assistant Examiner* — Premal Patel
(74) *Attorney, Agent, or Firm* — Stites & Harbison, PLLC; Juan Carlos A. Marquez, Esq

(57) ABSTRACT

The present invention prevents deterioration of image quality by lowering a heat value of a data driver connected to a liquid crystal display panel. In a liquid crystal display device, a pixel which connects a TFT thereof to one of two neighboring scanning signal lines and a pixel which has a TFT thereof connected to the other scanning signal line are alternately arranged in the extending direction of the scanning signal lines, two pixels which are arranged close to each other with one video signal line sandwiched therebetween have respective TFTs connected to the video signal line, and the connection relationship between the TFT of each pixel and the scanning signal line is inverted for every pair of two pixels arranged in the extending direction of the video signal lines.

6 Claims, 14 Drawing Sheets

LIQUID CRYSTAL DISPLAY DEVICE

The present application claims priority from Japanese application JP2006-250989 filed on Sep. 15, 2006, the content of which is hereby incorporated by reference into this application.

BACKGROUND OF THE INVENTION

1. Field of the Invention

The present invention relates to a liquid crystal display device, and more particularly to a technique which is effectively applicable to a liquid crystal display device having high resolution such as a liquid crystal television receiver set.

2. Description of the Related Art

Conventionally, an active-matrix-type liquid crystal display device has been used in a liquid crystal television receiver set and the like, for example. The active-matrix-type liquid crystal display device includes a liquid crystal display panel which seals a liquid crystal material between a pair of substrates, and switching elements (also referred to as active elements) such as TFTs are arranged in a matrix array on one substrate out of the pair of substrates.

The conventional liquid crystal display panel has, for example, the circuit constitution shown in FIG. 7 in general. FIG. 7 is a schematic circuit diagram showing one example of the circuit constitution of the conventional liquid crystal display panel. FIG. 7 shows the constitution in which four pixels are arranged in an x direction.

In the conventional liquid crystal display panel, for example, on one substrate out of the pair of substrates (hereinafter, referred to as TFT substrates), a plurality of scanning signal line GL ($GL_1$, $GL_2$, . . . ) which extends in the x direction in an elongated manner, and a plurality of video signal lines DL ($DL_1$, $DL_2$, $DL_3$, $DL_4$, $DL_5$ . . . ) which extends in the y direction in an elongated manner are formed, and pixels each of which includes a TFT and a pixel electrode PX are arranged in a matrix array in the x direction as well as in the y direction. Here, a gate of the TFT is connected to the scanning signal line GL, a drain of the TFT is connected to the video signal line DL, and a source of the TFT is connected to the pixel electrode PX. Further, the pixel electrode PX forms a pixel capacitance (also referred to as a liquid crystal capacitance) together with a liquid crystal material LC and a common electrode CT.

Further, in the liquid crystal display panel which corresponds to a color display used in a liquid crystal television receiver set or the like, four pixels shown in FIG. 7 are referred to as subpixels. When an RGB-method color liquid crystal display panel is adopted as the liquid crystal display panel, one dot of an image is constituted of three sub pixels, that is, a sub pixel which performs a display of R (red), a sub pixel which performs a display of G (green), and a sub pixel which performs a display of B (blue). Here, the plurality of pixels (sub pixels) which is arranged in the x direction is periodically arranged in order of the sub pixel which performs the display of R (red), the sub pixel which performs the display of G (green) and the sub pixel which performs the display of B (blue), for example.

Further, in the conventional general liquid crystal display panel, one scanning signal line GL is arranged for the plurality of pixels arranged in a row in the x direction, and TFT elements of the plurality of pixels which are arranged in a row in the x direction are connected to a common scanning signal line GL ($GL_1$). In the same manner, one video signal line DL is arranged for the plurality of pixels arranged in a row in the y direction, and TFT elements of the plurality of pixels arranged in a row in the y direction are connected to a common video signal line DL.

However, in case of the liquid crystal display panel having the pixel constitution shown in FIG. 7, for example, the number of drive circuits (data drivers) which generate video signals (gradation voltages) which are inputted to the respective video signal lines DL is increased thus giving rise to drawbacks that the power consumption is increased, and a potential of the video signal becomes unstable along with the increase of heat value of the data driver thus lowering image quality, for example.

Accordingly, in a recent liquid crystal display panel, for example, as shown in FIG. 8, there has been proposed a liquid crystal display panel having the circuit constitution referred to as a double-scanning line method in which, with respect to the plurality of pixels arranged in a row in the extending direction of the scanning signal lines GL, one video signal line DL ($DL_1$, $DL_2$, . . . ) is arranged for every two neighboring pixels, and two scanning signal lines GL ( . . . , $GL_{n-1}$, $GL_n$, $GL_{n+1}$, $GL_{n+2}$, . . . ) are arranged to sandwich the plurality of pixels arranged in a row. FIG. 8 is a schematic circuit diagram showing one example of the circuit constitution of a conventional liquid crystal display panel which adopts a double-scanning line method. FIG. 8 shows the constitution in which four pixels are arranged in an x direction.

Here, the plurality of pixels arranged in the x direction is configured such that the pixel which has a gate of a TFT thereof connected to the scanning signal line $GL_{n+1}$ and the pixel which has a gate of the TFT thereof connected to the scanning signal line $GL_n$ are alternately arranged. One example of a display method of an image in the liquid crystal display panel having such circuit constitution is briefly explained in conjunction with FIG. 9A and FIG. 9B. FIG. 9A is a schematic circuit diagram showing one constitutional example of the conventional liquid crystal display panel which adopts the double-scanning line method and polarities of pixel electrodes within 1 frame period. FIG. 9B is a schematic view showing one example of a driving method of the liquid crystal display panel having the constitution shown in FIG. 9A.

In the liquid crystal display panel having the double-scanning line method circuit constitution shown in FIG. 8, assume a row which is constituted of the plurality of pixels arranged in the x direction as a pixel row, for example, as shown in FIG. 9A, the relative positional relationship (connection relationship) among the TFT of each pixel, the scanning signal line GL and the video signal line DL agrees with each other in all pixel rows. In displaying video data amounting to 1 frame period on the display panel having such constitution, for example, as shown in FIG. 9B, a common voltage Vcom applied to common electrodes CT is set to a fixed value, and the respective scanning signal lines GL ( . . . , $GL_n$, $GL_{n+1}$, $GL_{n+2}$, $GL_{n+3}$, $GL_{n+4}$, $GL_{n+5}$, $GL_{n+6}$, . . . ) sequentially turn on the scanning signal at fixed time intervals. Here, to the video signal line $DL_1$, for example, as shown in FIG. 9B, a video signal (gradation voltage of positive polarity) having a potential of equal to or higher than the common voltage Vcom is inputted in conformity with timing that the scanning signal of the scanning signal line $GL_n$ is turned on, while a video signal (gradation voltage of negative polarity) having a potential of equal to the common voltage Vcom or lower than the common voltage Vcom is inputted, in conformity with the timing that the scanning signal of the scanning signal line $GL_{n+1}$ is turned on. Thereafter, each time the scanning signal line on which the scanning signal is turned on is changed, the gradation voltage of positive polarity and the gradation voltage of negative polarity are inputted alternately.

However, when the video signal and the scanning signal are inputted by the method shown in FIG. 9B, the polarities of the respective pixels when the video data amounting to 1 frame period is displayed become a polarity as shown in FIG. 9A, for example. Here, in FIG. 9A, "+" indicated in respective pixel electrodes PX implies that the gradation voltage of positive polarity is written in the pixel electrode PX, while "−" indicated in respective pixel electrodes PX implies that the gradation voltage of negative polarity is written in the pixel electrode PX. That is, in case of the liquid crystal display device having the constitution shown in FIG. 9A and FIG. 9B, the pixel electrodes of the plurality of pixels arranged in the extending direction of the video signal lines DL assume the gradation voltages of the same polarity. Accordingly, for example, there may be a case that stripes in the longitudinal direction appear on a display screen thus lowering display quality.

Further, with respect to the above-mentioned liquid crystal display panel which adopts the double-scanning line method, for example, as disclosed in patent document 1, there has been known a liquid crystal display panel having the circuit constitution which prevents the occurrence of a phenomenon referred to as line crawling so as to enhance display grade (display quality). The circuit constitution described in patent document 1 may be configured as shown in FIG. 10, for example, wherein a liquid crystal drive voltage which inverts the polarities of pixel electrodes for every pixel of multiplication of 2 in the direction along the video signal line DL and, at the same time, inverts the polarities of the pixel electrodes for every 2 pixels controlled by the same data line in the direction along the scanning signal line GL is added to respective pixel electrodes. Here, FIG. 10 is a schematic circuit diagram showing the arrangement of TFTs and the polarities of respective pixel electrodes by reference to the circuit constitution described in the following patent document 1.

[Patent document 1] JP-A-11-326869 (corresponding U.S. Pat. No. 6,552,707)

However, in the conventional liquid crystal display panel which adopts the double-scanning line method, in general, the common voltage Vcom applied to the common electrodes CT is fixed and hence, the data driver is required to form the video signal (gradation voltage) which adopts amplitude twice as large as potential difference between the common voltage Vcom and the maximum gradation voltage of positive polarity as maximum amplitude. Accordingly, in case of the liquid crystal display device of high resolution such as a liquid crystal television receiver set, even when the double-scanning line method is adopted, there exists a drawback that a heat value of a data driver is high, and a potential of the video signal becomes unstable and hence, image quality is liable to be easily lowered.

Further, in driving the liquid crystal display panel, for example, it is desirable to adopt dot inversion driving which can realize a high-quality display with high contrast and low crosstalk. That is, it is desirable that the polarities of the gradation voltages written in the pixel electrodes of two neighboring pixels in the extending direction of the scanning signal line and the polarities of gradation voltages written in the pixel electrodes of two neighboring pixels in the extending direction of the video signal line always become polarities opposite to each other.

However, for example, to make the liquid crystal display panel having the constitution shown in FIG. 9A perform the dot inversion driving, it is necessary to invert the order of positive polarity and negative polarity of the video signal applied to one video signal line DL (for example, $DL_1$) for every two pixels in order of positive polarity, negative polarity, negative polarity, positive polarity, positive polarity, negative polarity, . . . and, at the same time, it is necessary to invert the polarity of the video signal applied to two neighboring video signal lines (for example, $DL_1$ and $DL_2$). Accordingly, the number of times for inverting the polarity is increased thus giving rise to a drawback that the potential of the video signal is liable to easily become unstable.

Further, for example, in case of the liquid crystal display panel having the constitution shown in patent document 1 (FIG. 10), display quality is enhanced using a driving method different from dot inversion driving. This gives rise to a drawback that dot inversion driving is difficult.

SUMMARY OF THE INVENTION

It is an object of the present invention to provide a technique which can prevent the deterioration of image quality by lowering a heat value of the data driver connected to the liquid crystal display panel, for example.

It is another object of the present invention to provide a technique which can make a liquid crystal display panel which adopts a double-scanning line method easily perform dot inversion driving, for example.

The above-mentioned and other objects and novel features of the present invention will become apparent from the description of this specification and attached drawings.

The following is an explanation of the summary of typical inventions among the inventions disclosed in this specification.

(1) The present invention is directed to a liquid crystal display device including: a display panel which includes a plurality of video signal lines, a plurality of scanning signal lines, and pixels each of which includes a switching element and a pixel electrode and forms a pixel capacitance by the pixel electrode, a liquid crystal material and a common electrode, and has a display region which is constituted by arranging a plurality of pixels in the extending direction of the video signal lines and the extending direction of the scanning signal lines respectively; a first drive circuit which inputs a video signal to the plurality of video signal lines; a second drive circuit which inputs a scanning signal sequentially to the plurality of scanning signal lines; and a common voltage control circuit which controls a potential of a common voltage inputted to the common electrodes, wherein the plurality of video signal lines is arranged such that one video signal line is allocated to two neighboring pixel electrodes with respect to the plurality of pixel electrodes arranged in a row in the extending direction of the scanning signal lines, the plurality of scanning signal lines is arranged such that two scanning signal lines are arranged between two neighboring pixel electrodes arranged in the extending direction of the video signal lines and, at the same time, two scanning signal lines are arranged to sandwich the plurality of pixel electrodes with respect to the plurality of pixel electrodes arranged in a row in the extending direction of the scanning signal lines, the plurality of pixels which is arranged in a row in the extending direction of the scanning signal lines is configured such that the pixel which connects the switching element thereof to the first scanning signal line out of two scanning signal lines which are arranged to sandwich the pixel electrodes of the plurality of pixels, and the pixel which connects the switching element thereof to the second scanning signal line out of two scanning signal lines are alternately arranged, two neighboring pixels which sandwich one video signal line therebetween are configured such that the switching element of each pixel is connected to one video signal line and, at the same time, a position of the pixel which connects the switching element thereof to the first scanning signal line out of two scanning signal lines and a position of the pixel which connects the switching element thereof to the second scanning signal line out of two scanning signal lines are inverted for every pair of two pixels arranged in the extending direction of the video signal lines, and the common voltage control circuit alternately changes over the potential of the common voltage between a first potential and a second potential higher than the first potential each time the scanning signal line to which the scanning signal is inputted from the second drive circuit is changed, and inputs the common voltage into the common electrodes, and the first drive circuit is configured such that when the common voltage of the first potential is inputted to the common electrode, a video signal of a potential equal to or higher than the first potential is inputted to the first drive circuit, and when the common voltage of the second potential is inputted to the common electrode, a video signal of a potential equal to or lower than the second potential is inputted to the first drive circuit.

(2) In the liquid crystal display device having the above-mentioned constitution (1), the switching element is a TFT (Thin Film Transistor), a gate of the TFT is connected to the scanning signal line, either one of a drain and a source of the TFT is connected to the video signal line, either one which is not connected to the video signal line out of the drain and the source of the TFT is connected to the pixel electrode.

According to the present invention, by allowing the liquid crystal display panel which adopts the double-scanning line method to perform common inversion driving, a heat value of the data drive can be lowered thus preventing the deterioration of image quality.

Further, according to the present invention, by adopting the common inversion driving, the liquid crystal display device adopts the dot inversion driving in appearance. Accordingly, the number of times that the polarity of the video signal is inverted can be drastically decreased thus easily enhancing display quality.

DESCRIPTION OF THE PREFERRED EMBODIMENTS

Hereinafter, the present invention is explained in detail in conjunction with an embodiment by reference to drawings.

Here, in all drawings for explaining the embodiment, parts having identical functions are given same symbols and their repeated explanation is omitted.

Figure 1:
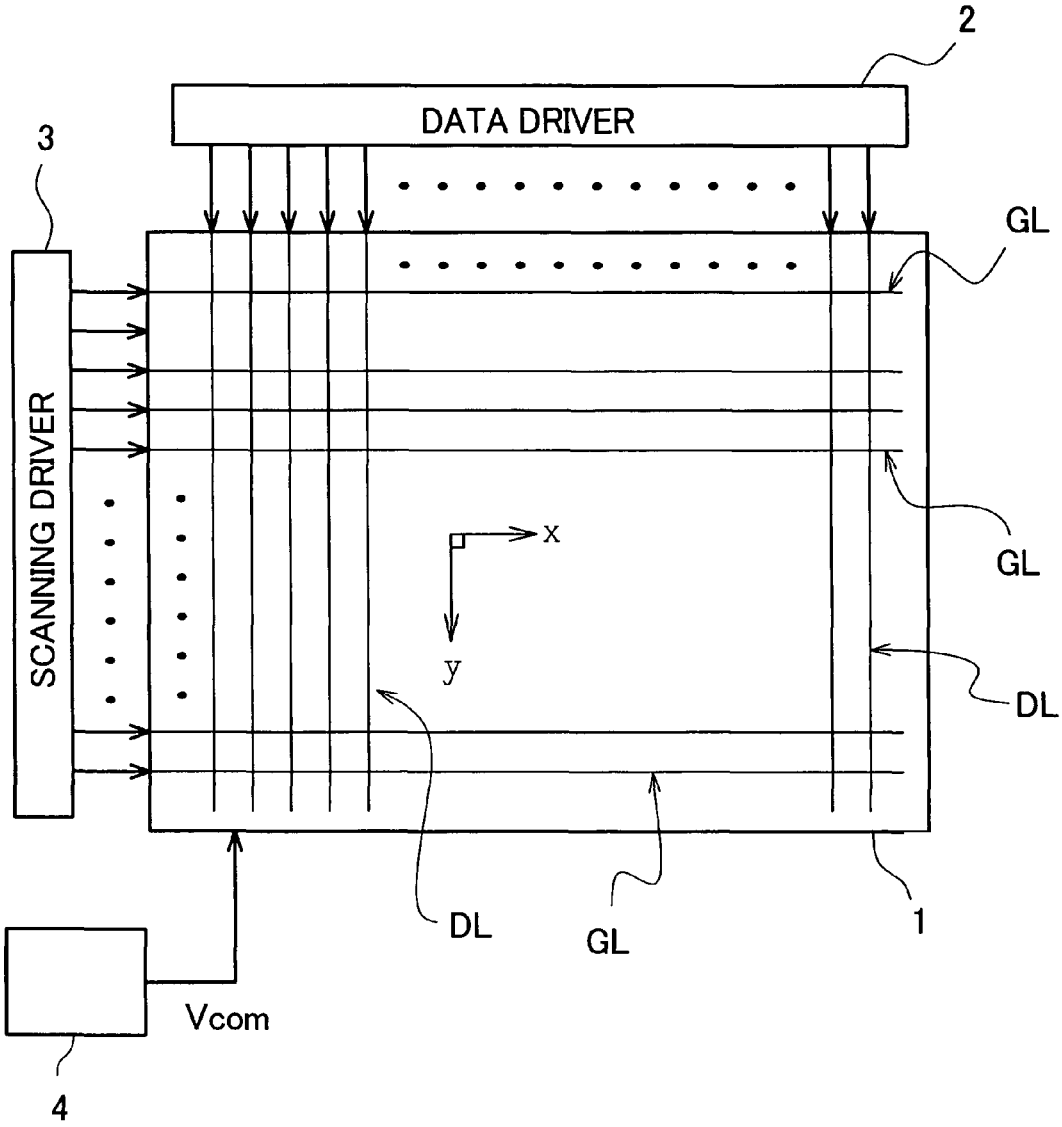
FIG. 1 is a schematic block diagram showing the schematic constitution of a liquid crystal display device of one embodiment according to the present invention.

FIG. 1 is a schematic block diagram showing the schematic constitution of a liquid crystal display device of one embodiment according to the present invention.

Figure 2A:
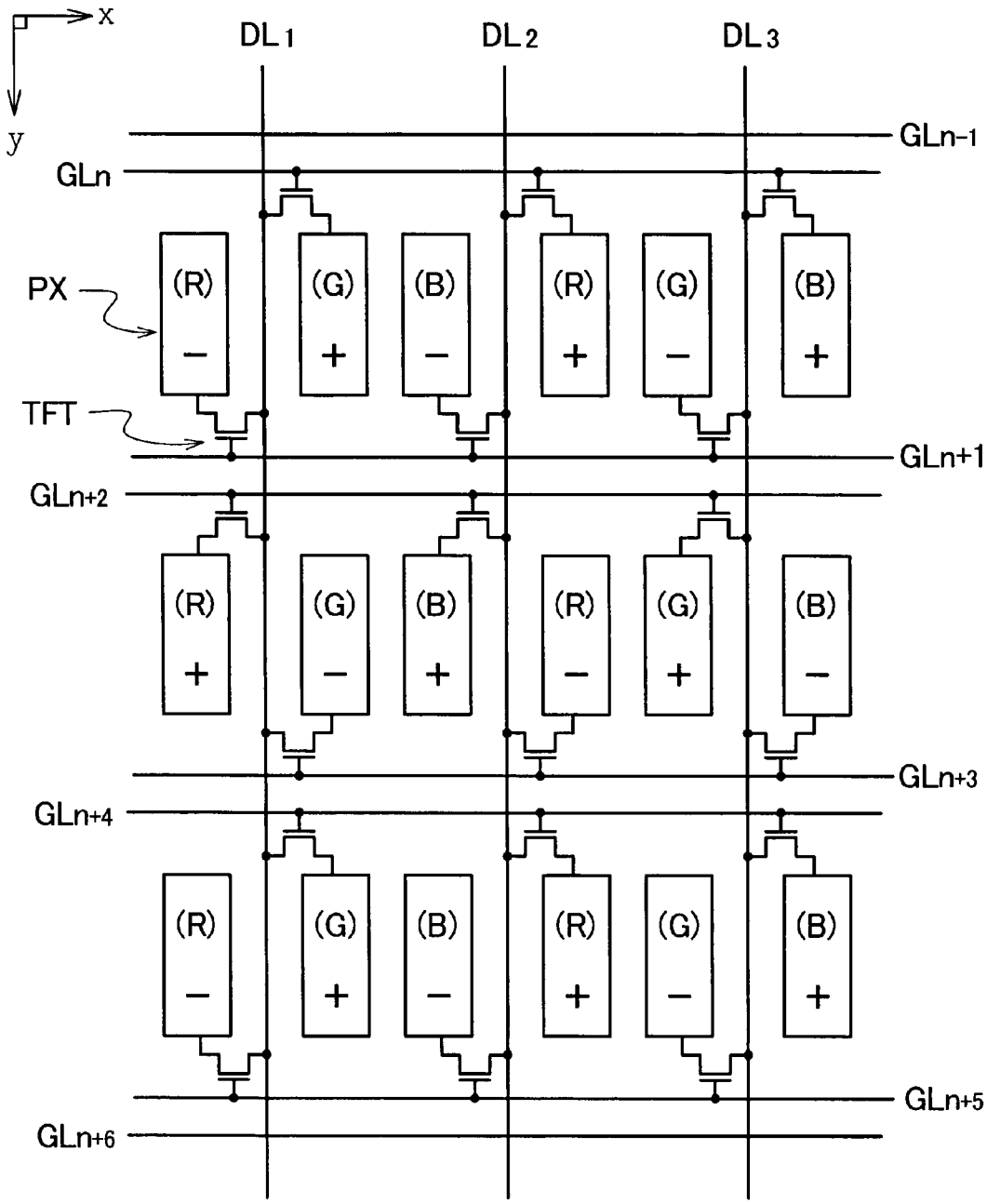
FIG. 2A is a schematic circuit diagram showing one constitutional example of a liquid crystal display panel of the embodiment and polarities of pixel electrodes within 1 frame period.
Figure 2B:
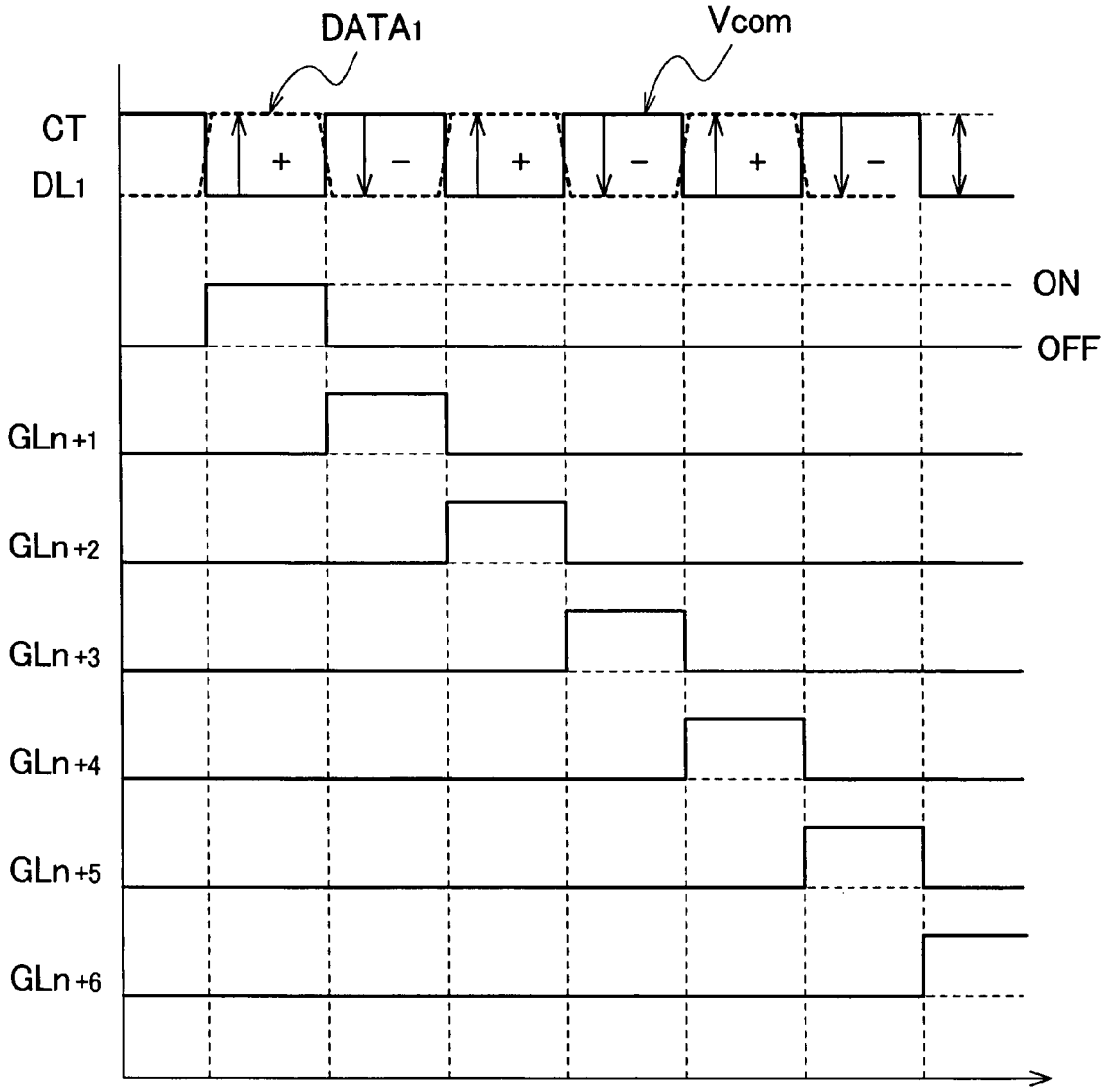
FIG. 2B is a schematic view showing one example of a driving method of the liquid crystal display panel having the constitution shown in FIG. 2A.

FIG. 2A is a schematic circuit diagram showing one constitutional example of a liquid crystal display panel of the embodiment and polarities of pixel electrodes within 1 frame period. FIG. 2B is a schematic view showing one example of a driving method of the liquid crystal display panel having the constitution shown in FIG. 2A.

The liquid crystal display device to which the present invention is applied includes, for example, as shown in FIG. 1, a liquid crystal display panel 1 having a plurality of video signal lines DL which extends in the y direction in an elongated manner and a plurality of scanning signal lines GL which extends in the x direction in an elongated manner, a data driver 2 which forms video signals (gradation voltages) which are inputted to the plurality of respective video signal lines DL, a scanning driver 3 which sequentially inputs scanning signals to the plurality of scanning signal lines GL, and a common voltage control circuit 4 which controls a potential of a common voltage Vcom which is inputted to common electrodes (not shown in the drawing) of the liquid crystal display panel 1. Further, although not shown in FIG. 1, the liquid crystal display device of the present invention includes, for example, a timing controller which forms clock signal for synchronizing operations of the data driver 2, the scanning driver 3 and the common voltage control circuit 4 or the like, a frame memory which temporarily stores video data inputted from an external system and the like.

The liquid crystal display panel 1 is a display panel which seals a liquid crystal material between a pair of substrates, wherein on one substrate out of the pair of substrates, as shown in FIG. 2A, pixels each of which has a TFT used as a switching element and a pixel electrode PX are arranged in a matrix array. Here, although not shown in FIG. 2A, the pixel electrode PX forms pixel capacitance (also referred to as liquid crystal capacitance) together with a liquid crystal material and a common electrode CT. Further, in the liquid crystal display panel of this embodiment, the common electrodes CT may be, as described later, formed on the substrate having the TFTs and the like or on another substrate.

Further, in the liquid crystal display panel which corresponds to a color display used in a liquid crystal television receiver set and the like, one pixel shown in FIG. 2A is referred to as a sub pixel. When an RGB-method color liquid crystal display panel is adopted as the liquid crystal display panel, one dot of an image is constituted of three sub pixels, that is, a sub pixel which performs a display of R (red), a sub pixel which performs a display of G (green), and a sub pixel which performs a display of B (blue). Here, the plurality of pixels (sub pixels) which is arranged in the x direction is periodically arranged in order of the sub pixel which performs the display of R (red), the sub pixel which performs the display of G (green), and the sub pixel which performs the display of B (blue), for example.

Further, in the liquid crystal display panel of this embodiment, the video signal lines DL ($DL_1$, $DL_2$, $DL_3$, . . . ) are configured such that one video signal line DL is arranged for each pair of pixels, wherein each pair is constituted of two neighboring pixels arranged in the extending direction (x direction) of the scanning signal line GL. Here, drains of the TFTs of two pixels which are arranged close to each other with one video signal line DL (for example, $DL_1$,) sandwiched therebetween are connected to the same video signal line $DL_1$.

Further, in the liquid crystal display panel of this embodiment, assuming a row consisting of a plurality of pixels which is arranged in the extending direction (x direction) of the scanning signal lines GL as a pixel row, two scanning signal lines GL are arranged to sandwich the pixel electrodes PX of the respective pixels of one pixel row. Further, between the pixel electrodes PX of two pixels arranged close to each other in the extending direction (y direction) of the video signal lines DL, two scanning signal lines GL are arranged. Here, in the pixel row which arranges the pixel electrodes PX between two neighboring scanning signal lines GL (for example, between $GL_n$ and $GL_{n+1}$), the pixel which has a gate of the TFT thereof connected to one scanning signal line $GL_{n+1}$ and the pixel which has a gate of the TFT thereof connected to another scanning signal line $GL_n$ are alternately arranged.

Further, with respect to one pair of pixels which is constituted of two pixels arranged close to each other with one video signal line DL (for example, $DL_1$) sandwiched therebetween, when viewed along the extending direction of the video signal line $DL_1$, a position (a direction) of the pixel having the TFT which is connected to the scanning signal line GL close to an input terminal of the video signal line $DL_1$ and a position (a direction) of the pixel having the TFT which is connected to the scanning signal line GL remote from the input terminal are inverted for every pair of two pixels.

By allowing the liquid crystal display panel of this embodiment to have the circuit constitution shown in FIG. 2A and to perform common inversion driving, a heat value of a data driver can be reduced and, at the same time, a dot inversion driving can be realized. Here, the liquid crystal display panel is driven by a method shown in FIG. 2B, for example.

In displaying video data amounting to 1 frame period in the liquid crystal display panel of this embodiment, for example, as shown in FIG. 2B, a scanning signal inputted to the respective scanning signal lines GL ( . . . , $GL_n$, $GL_{n+1}$, $GL_{n+2}$, $GL_{n+3}$, $GL_{n+4}$, $GL_{n+5}$, $GL_{n+6}$, . . . ) is sequentially turned on at fixed time intervals. A control of the scanning signal is performed by the scanning driver 3. For example, when a frame rate (also referred to as a refresh rate) is 60 Hz, the scanning signal inputted to the respective scanning signal lines is sequentially turned on in response to a clock signal from the timing controller using 1/60 seconds as one period.

Here, a common voltage Vcom inputted to the common electrodes is inputted with a potential thereof alternately changed over between a first potential and a second potential higher than the first potential in synchronism with timing that the scanning signal line GL which turns on the scanning signal is changed over. The changeover of the potential of the common voltage Vcom is performed by the common voltage control circuit 4, wherein the potential is changed over in synchronism with a clock signal used by the scanning driver 3.

Further, a video signal line $DATA_1$ inputted to the video signal line DL (for example, $DL_1$) forms a gradation voltage having a potential equal to or higher than the first potential during a period in which the common voltage Vcom is inputted with the first potential, and forms a gradation voltage of a potential equal to or lower than the second potential during a period in which the common voltage Vcom is inputted with the second potential. The formation of the gradation voltage is performed by the data driver 2, wherein the gradation voltage is formed in synchronism with the clock signal used in the scanning driver 3 and the changeover timing of the potential in the common voltage control circuit 4.

Due to such an operation, to the pixel electrode PX of the pixel which has a gate of the TFT thereof connected to the scanning signal line GL (for example, $GL_n$) on which the scanning signal is turned on during the period in which the common voltage Vcom is inputted with the first potential, the gradation voltage having a potential equal to or higher than the potential of the common voltage Vcom, that is, the gradation voltage of positive polarity is written. Further, to the pixel electrode PX of the pixel which has a gate of the TFT thereof connected to the scanning signal line GL (for example, $GL_{n+1}$) on which the scanning signal is turned on during the period in which the common voltage Vcom is inputted with the second potential, the gradation voltage having a potential equal to or lower than the potential of the common voltage Vcom, that is, the gradation voltage of negative polarity is written.

Although the video signal $DATA_1$ inputted to one video signal line $DL_1$ only is shown in FIG. 2B, the video signal is also inputted to the remaining video signal lines DL ($DL_2$, $DL_3$, . . . ) in the same pattern. That is, for example, the above-mentioned gradation voltage of positive polarity is written in the pixel electrodes PX of all pixels which have gates of the TFTs thereof connected to the scanning signal lines $GL_n$.

When the gradation voltage amounting to 1 frame period is written in the pixel electrodes of the respective pixels in this manner, the polarity of the respective pixel electrodes PX become as shown in FIG. 2A, for example. Here, in FIG. 2A, symbol "+" is given to the pixel electrodes PX in which the gradation voltage of positive polarity is written, and symbol "−" is given to the pixel electrodes PX in which the gradation voltage of negative polarity is written.

In this manner, by allowing the liquid crystal display panel of this embodiment to perform common inversion driving for every pixel row unit as shown in FIG. 2B, it is possible to realize an inversion mode equal to dot inversion driving.

Figure 9A:
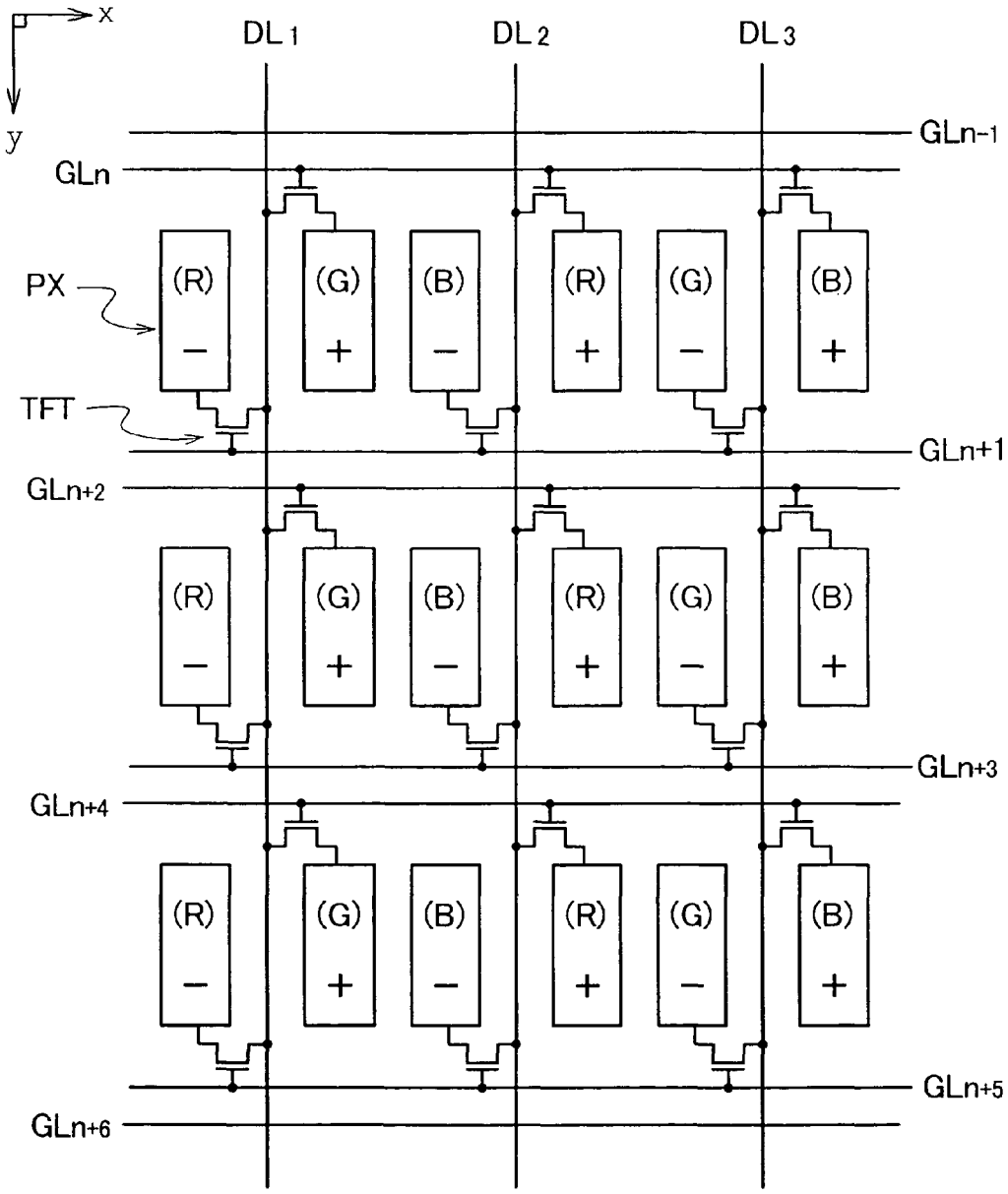
FIG. 9A Prior Art
FIG. 9A is a schematic circuit diagram showing one constitutional example of the conventional liquid crystal display panel which adopts the double-scanning line method and polarities of pixel electrodes within 1 frame period.
Figure 9B:
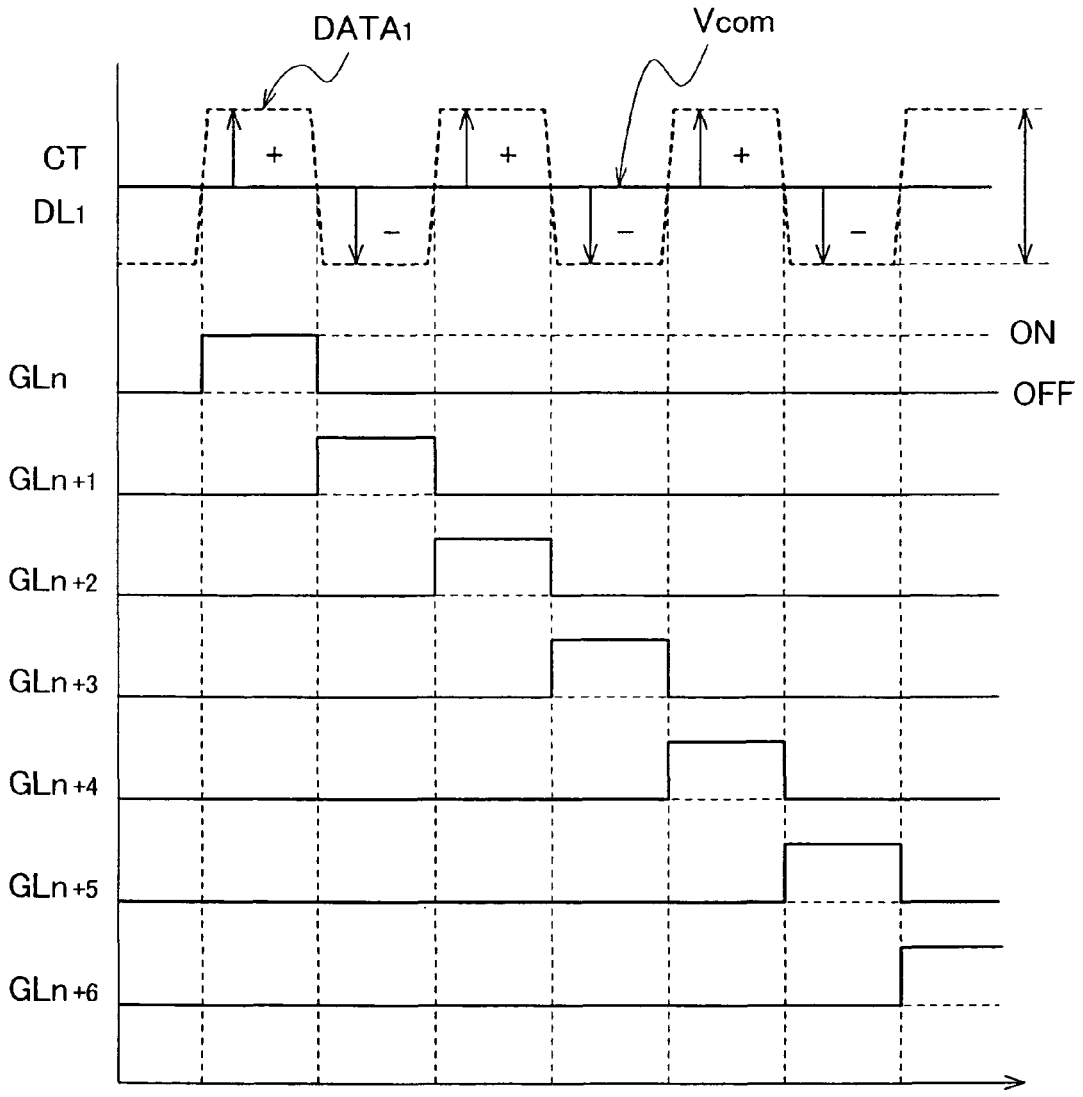
FIG. 9B Prior Art
FIG. 9B is a schematic view showing one example of a driving method of the liquid crystal display panel having the constitution shown in FIG. 9A.
Figure 10:
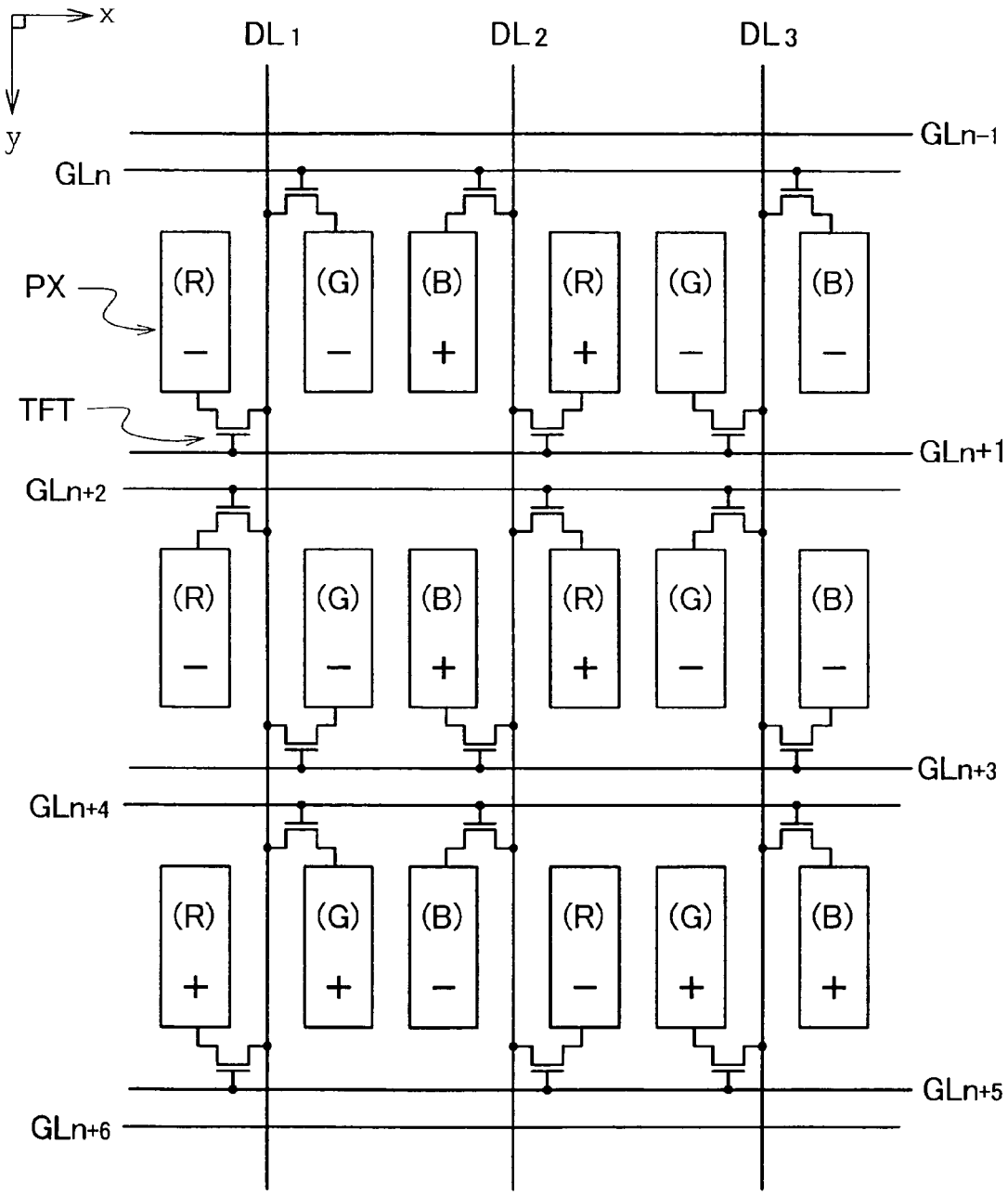
FIG. 10 Prior Art
FIG. 10 is a schematic circuit diagram showing the arrangement of TFTs and the polarities of respective pixel electrodes by reference to the circuit constitution described in patent document 1.

Further, in the liquid crystal display panel of this embodiment, in forming the video signal (gradation voltage) inputted to the respective video signal lines DL in the data driver 2, the inversion relationship of positive polarity and negative polarity in the respective video signal lines DL is equal. That is, the polarities of the gradation voltages written in the pixel electrodes of the respective pixels connected to one scanning signal line are the same. Accordingly, compared to the conventional liquid crystal display device which adopts the double-scanning line method, the number of times that the polarity of the video signal is inverted by the data driver 2 can be drastically decreased thus lowering the power consumption and a heat value of the data driver 2. Further, by allowing the liquid crystal display panel of this embodiment to perform the common inversion driving, for example, compared to the driving method explained in conjunction with FIG. 9B, maximum amplitude of the gradation voltage formed by the data driver 2 can be halved thus further reducing the heat value of the data driver 2. As a result, the potential of the video signal can be stabilized thus enhancing display quality.

Figure 3A:
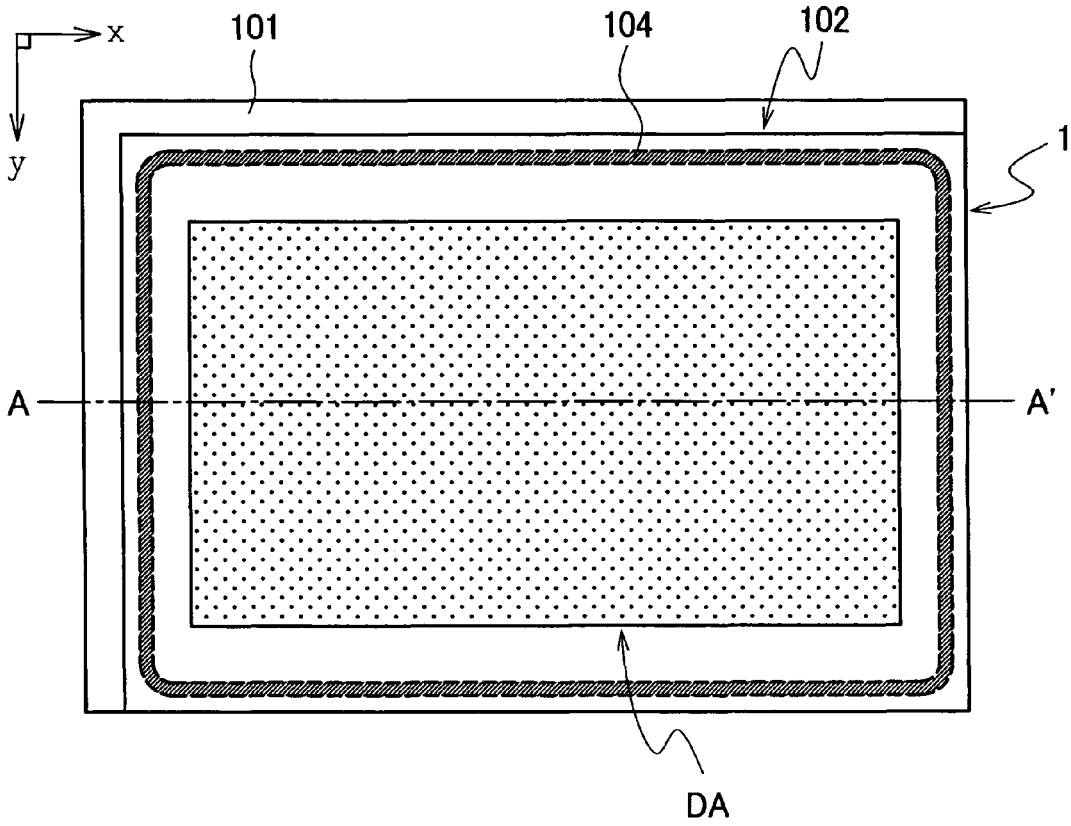
FIG. 3A is a schematic plan view showing one example of the schematic constitution of the liquid crystal display panel.
Figure 3B:
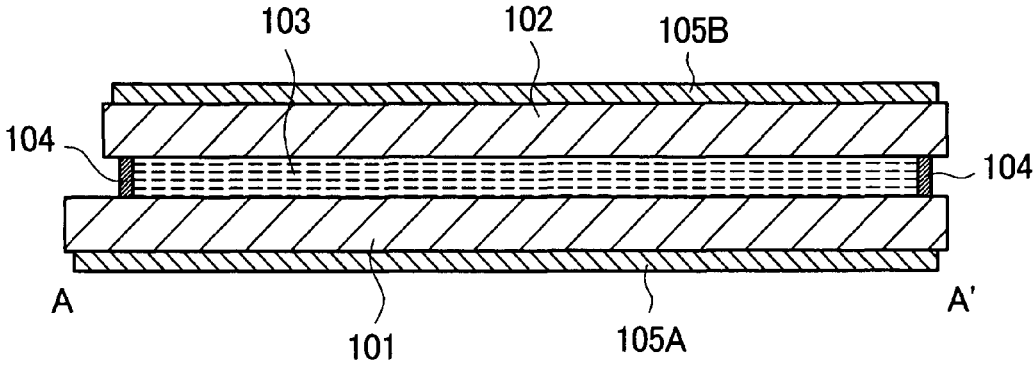
FIG. 3B is a schematic cross-sectional view showing one example of the cross-sectional constitution taken along a line A-A' in FIG. 3A.

FIG. 3A is a schematic plan view showing one example of the schematic constitution of the liquid crystal display panel. FIG. 3B is a schematic cross-sectional view showing one example of the cross-sectional constitution taken along a line A-A' in FIG. 3A.

Figure 4A:
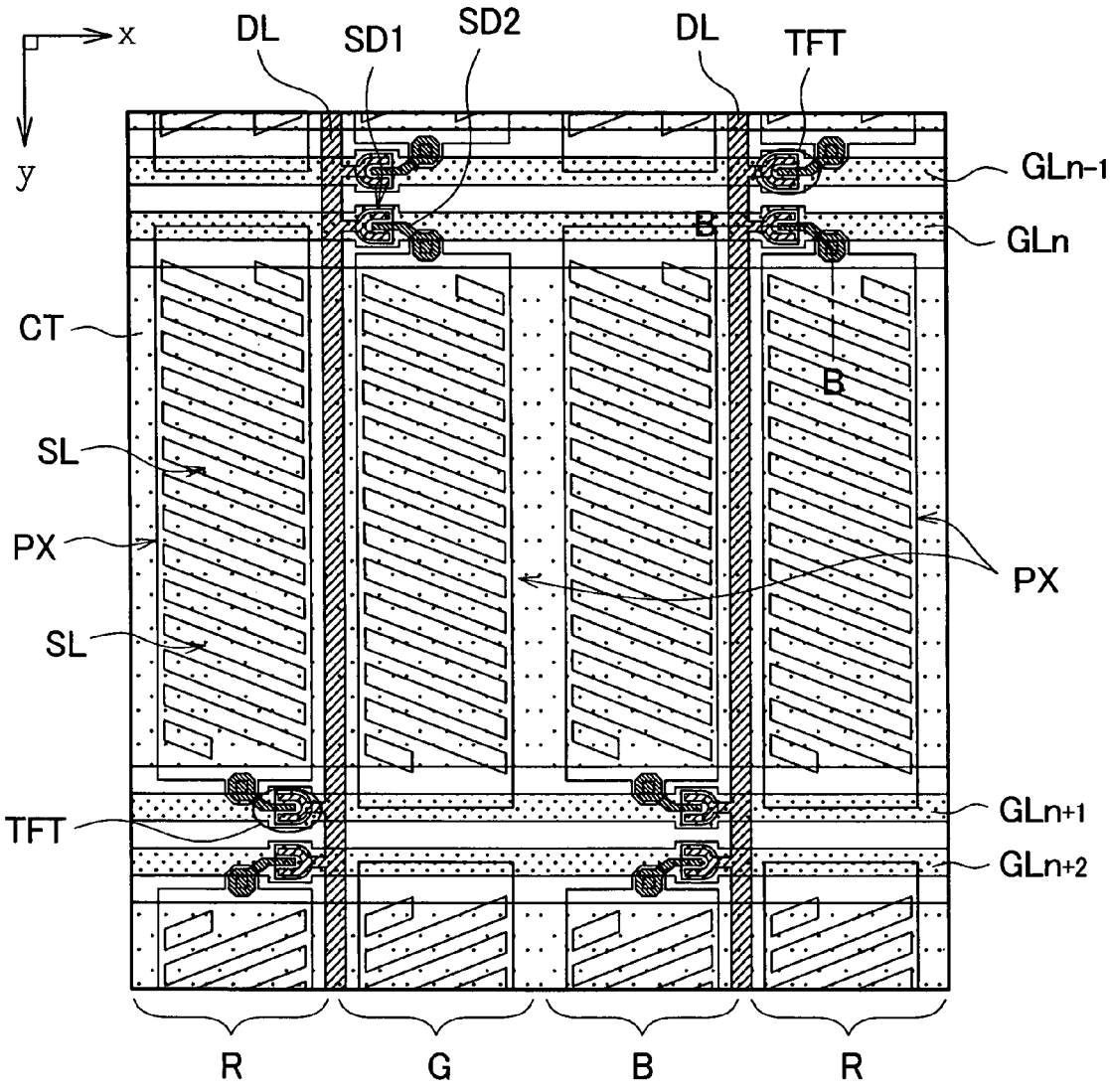
FIG. 4A is a schematic plan view showing a first constitutional example of a TFT substrate of the liquid crystal display panel shown in FIG. 3A and FIG. 3B.
Figure 4B:
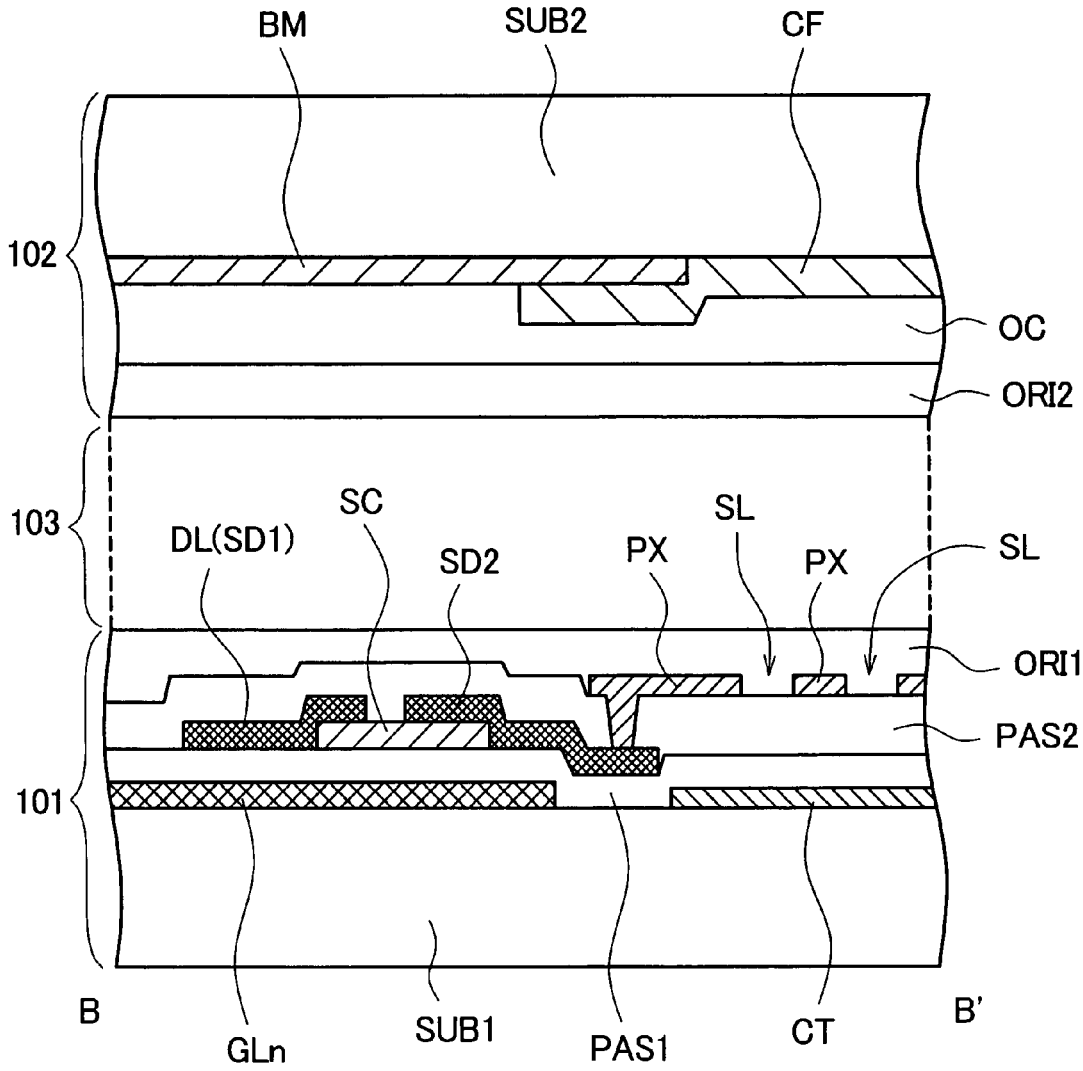
FIG. 4B is a schematic cross-sectional view showing one example of the cross-sectional constitution of the liquid crystal display panel taken along a line B-B' in FIG. 4A.

FIG. 4A is a schematic plan view showing a first constitutional example of a TFT substrate of the liquid crystal display panel shown in FIG. 3A and FIG. 3B. FIG. 4B is a schematic cross-sectional view showing one example of the cross-sectional constitution of the liquid crystal display panel taken along a line B-B' in FIG. 4A.

The liquid crystal display panel 1 of this embodiment is, for example, as shown in FIG. 3A and FIG. 3B, configured such that a liquid crystal material 103 is sealed between a pair of substrates consisting of a TFT substrate 101 and a counter substrate 102. Here, for example, the TFT substrate 101 and the counter substrate 102 are adhered to each other using a sealing material 104 which is arranged annularly outside a display region DA, and the liquid crystal material 103 is sealed in a space surrounded by the TFT substrate 101, the counter substrate 102 and the sealing material 104.

Further, when the liquid crystal display panel 1 is of a transmissive type or a transflective type, on surfaces of the TFT substrate 101 and the counter substrate 102 which are directed to the outside of the TFT substrate 101 and the counter substrate 102, a pair of polarizers 105A, 105B is arranged. Here, although not shown in FIG. 3B, for example, a retardation plate having the one-layer structure or the multi-layered structure is arranged between the TFT substrate 101 and the polarizer 105A and between the counter substrate 102 and the polarizer 105B respectively.

When the liquid crystal display panel 1 is of a reflective type, for example, the polarizer 105A, the retardation plate and the like which are arranged on a TFT-substrate-101 side are usually unnecessary.

In the display region DA of the liquid crystal display panel 1 having such a constitution, for example, the video signal lines DL, the scanning signal lines GL, the TFTs, the pixel electrodes PX and the like are formed to provide the constitution equivalent to the circuit constitution shown in FIG. 2A. When the liquid crystal display panel 1 is of a lateral electric field driving method referred to as an IPS (In-Plane Switching), for example, the video signal lines DL, the scanning signal lines GL, the TFTs, the pixel electrodes PX, the counter electrodes CT are formed on the TFT substrate 101. This constitution corresponds to the constitution shown in FIG. 4A and FIG. 4B, for example.

In the lateral-electric-field driving method, with respect to the TFT substrate 101, as shown in FIG. 4A and FIG. 4B, for example, on a surface of an insulation substrate SUB1 such as a glass substrate, a plurality of scanning signal lines GL and a plurality of counter electrodes CT are formed. The scanning signal lines GL are formed by etching a conductive film made of aluminum or the like, for example, and the counter electrodes CT are formed by etching a conductive film having high optical transmissivity such as ITO, for example. Further, the counter electrodes CT are formed in a strip shape between two scanning signal lines which are arranged close to each other with 1 pixel row sandwiched therebetween (for example, between scanning signal lines $GL_n$ and $GL_{n+1}$), for example. Further, the respective strip-like counter electrodes CT are electrically connected with each other via a bus line outside the display region DA, for example. The cross-sectional constitution shown in FIG. 4B is one constitutional example when the scanning signal lines GL and the counter electrodes CT are formed by steps independent from each other, for example. The scanning signal lines GL and the counter electrodes CT may be formed such that the ITO film and the conductive film are formed on the surface of the insulation substrate SUB 1 sequentially and, thereafter, these films are collective etched, for example. In this case, between the insulation substrate SUB 1 and the scanning signal lines GL, an ITO film having the substantially same pattern as the scanning signal lines GL is formed.

Further, on the scanning signal lines GL and the counter electrodes CT, semiconductor layers SC, video signal lines DL (drain electrodes SD1) and the source electrodes SD2 are formed by way of a first insulation layer PAS1. The semiconductor layers SC are formed by etching an amorphous silicon (a-Si) film and, thereafter, by implanting impurities into drain regions and source regions, for example. The video signal lines DL and the source electrodes SD2 are formed by etching a conductive film made of aluminum or the like, for example. Further, the drain electrodes SD1 are formed by branching portions of the video signal lines DL. Here, the branching direction is determined to be equivalent to the circuit shown in FIG. 2A. Here, in the example shown in FIG. 4A, the drain electrodes SD1 have a U-shape in a plan view and are arranged such that the extending direction of the scanning signal lines GL becomes the vertical direction. However, the drain electrodes SD1 is not limited to such configuration and the drain electrodes SD1 may be arranged such that the extending direction of the video signal lines DL becomes the vertical direction. Still further, a planar shape of the drain electrodes SD1 is not limited to a U-shape and may be formed in a linear shape or in a stepped shape.

Further, on the video signal lines DL or the like, the pixel electrodes PX are formed by way of a second insulation layer PAS2. The pixel electrodes PX are formed by etching a conductive film having high optical transmissivity made of ITO or the like, for example, and are connected with the source electrodes SD2 via through holes TH. Further, the pixel electrodes PX are formed in a comb-teeth shape having a plurality of slits SL on regions where the slits SL overlap the counter electrodes CT in a plan view. Here, it is needless to say that the number, the direction or the like of the slits SL can be properly changed.

Further, an orientation film ORI1 is formed on the pixel electrodes PX.

On the other hand, with respect to the counter substrate 102, on a surface of the insulation substrate SUB2 formed of a glass substrate or the like, a light blocking film BM which is referred to as a black matrix and color filters CF are formed. The light blocking film BM is formed in a grid pattern to separate the respective pixels by etching a conductive film or an insulation film having optical transmissivity of approximately 0, for example. The color filters CF are formed by etching an insulation film or exposing and developing an insulation film, for example. Further, the color filters CF are formed such that in opening regions of the light blocking film BM, a filter serving for a display of R (red), a filter serving for a display of G (green) and a filter serving for a display of B (blue) are arranged periodically.

Further, on the light blocking film BM and the color filters CF, an orientation film ORI2 is formed by way of an overcoat layer OC, for example.

In this manner, in the liquid crystal display panel 1 which adopts a lateral electric field driving method, by providing the structure equivalent to the circuit constitution shown in FIG. 2A as the structure of the TFT substrate 101 and by driving the liquid crystal display panel 1 by the method explained in conjunction with FIG. 2B, a heat value of the data driver 2 can be reduced thus enhancing display quality. Further, by adopting a common inversion driving for each pixel row, it is possible to easily realize an inversion mode equal to dot inversion driving.

Here, in this embodiment, as the constitutional example of the liquid crystal display panel 1 which adopts a lateral electric field driving method, the constitution shown in FIG. 4A and FIG. 4B is exemplified. However, it is needless to say that the present invention is not limited to the above-mentioned constitutions and is applicable to the constitutions which adopt various lateral electric field driving methods. Further, FIG. 4A and FIG. 4B exemplify the constitution in which the common electrodes CT and the pixel electrodes PX are formed by way of the insulation layers PAS1, PAS2, and the pixel electrodes PX have the slits SL. However, it is needless to say that the present invention is not limited to such constitution and the common electrodes CT and the pixel electrodes PX may be formed on the same layer.

Figure 5A:
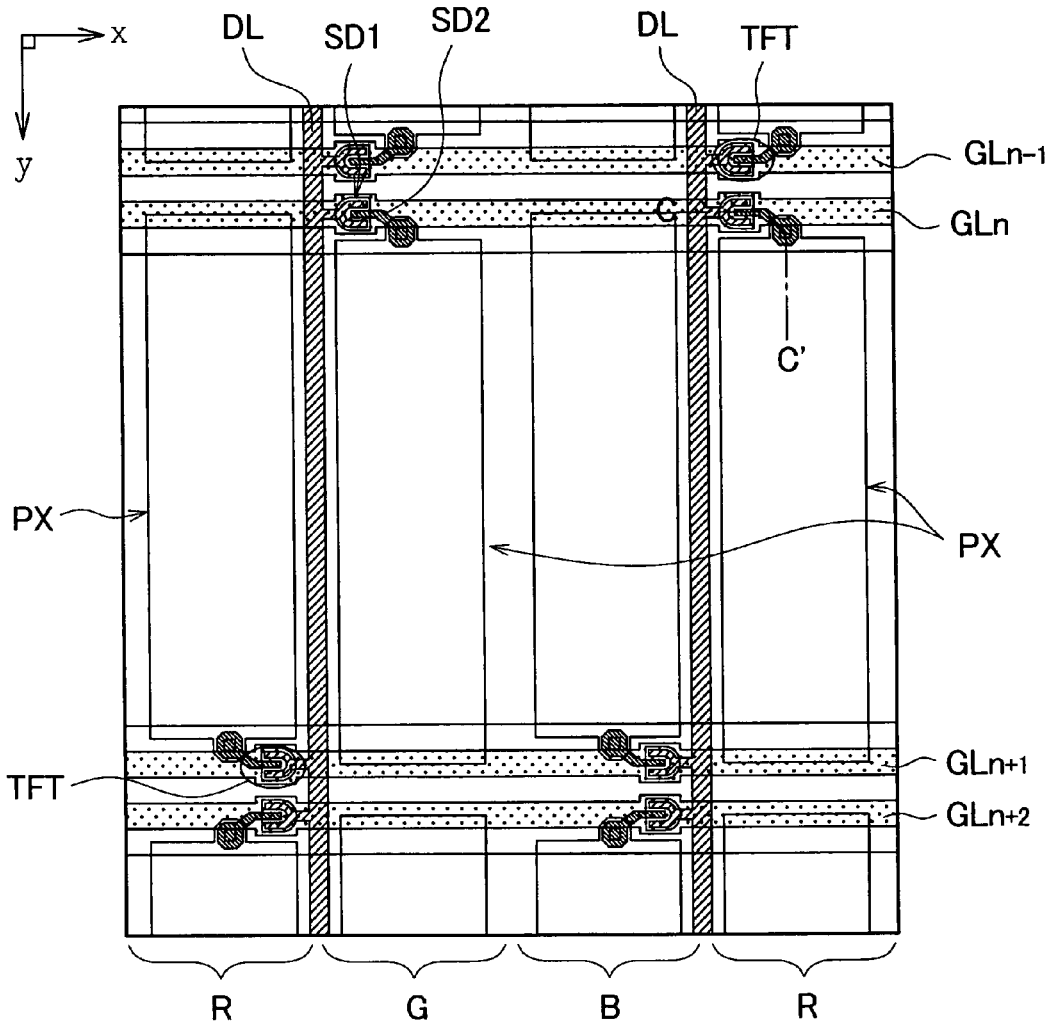
FIG. 5A is a schematic plan view showing a second constitutional example of the TFT substrate of the liquid crystal display panel shown in FIG. 3A and FIG. 3B.
Figure 5B:
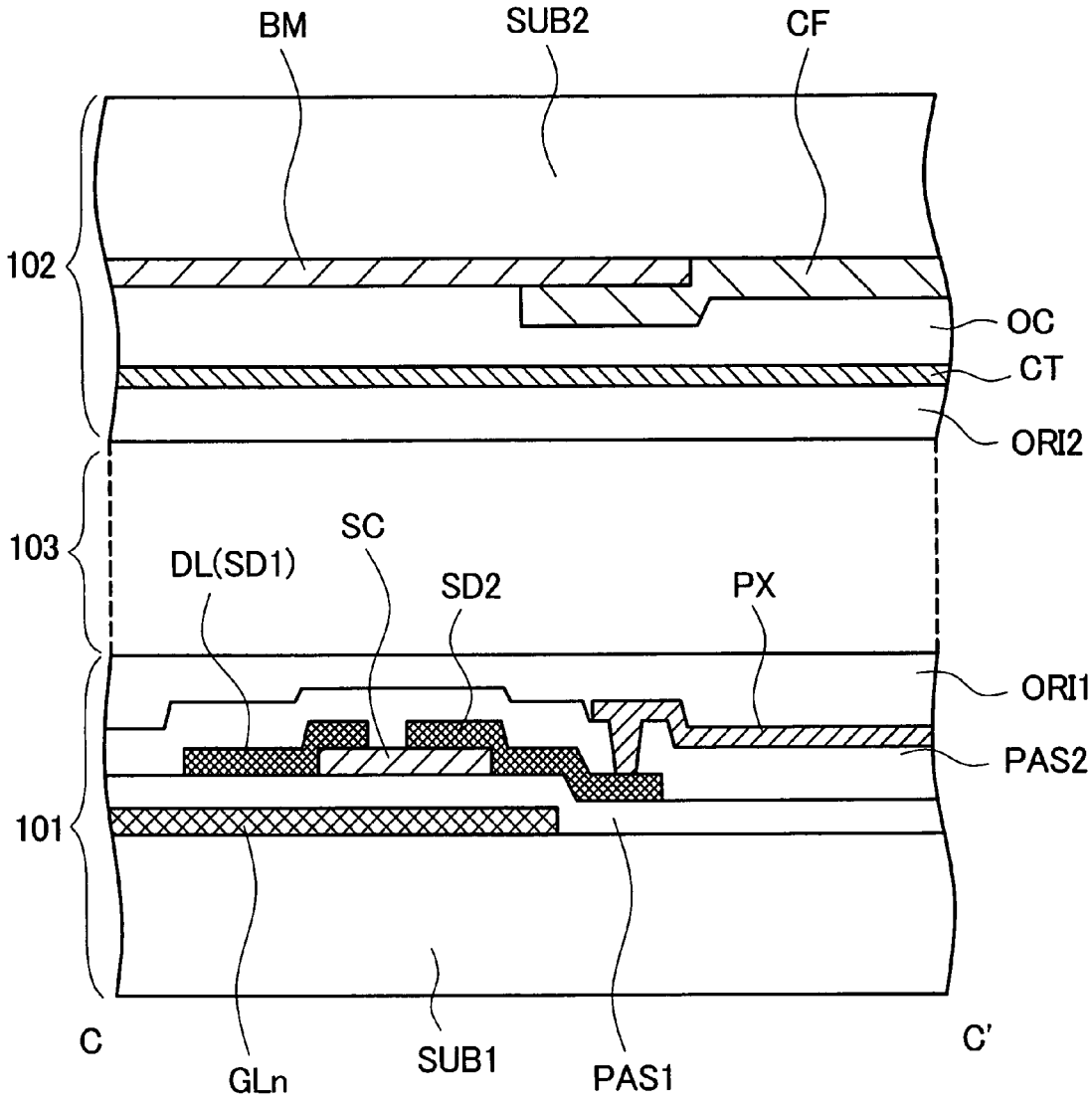
FIG. 5B is a schematic cross-sectional view showing one example of the cross-sectional constitution of the liquid crystal display panel taken along a line C-C' in FIG. 5A.

FIG. 5A is a schematic plan view showing a second constitutional example of the TFT substrate of the liquid crystal display panel shown in FIG. 3A and FIG. 3B. FIG. 5B is a schematic cross-sectional view showing one example of the cross-sectional constitution of the liquid crystal display panel taken along a line C-C' in FIG. 5A.

The liquid crystal display panel 1 of this embodiment is not limited to the liquid crystal display panel which adopts the lateral electric field driving method in which the pixels within the display region DA have the constitution shown in FIG. 4A and FIG. 4B, and may be a liquid crystal display panel which adopts a vertical electric field driving method in which the common electrodes CT are mounted on the counter-substrate-102 side. One constitutional example of the liquid crystal display panel 1 which adopts the vertical electric field driving method is shown in FIG. 5A and FIG. 5B.

When the liquid crystal display panel 1 adopts the vertical electric field driving method, with respect to the TFT substrate 101, for example, as shown in FIG. 5A and FIG. 5B, on the surface of the insulation substrate SUB1 formed of a glass substrate or the like, only a plurality of scanning signal lines GL is formed.

Further, on the scanning signal lines GL, semiconductor layers SC, video signal lines DL (drain electrodes SD1) and the source electrodes SD2 are formed by way of a first insulation layer PAS1. Also in this case, the drain electrodes SD1 are formed by branching portions of the video signal lines DL, and the branching direction is determined to be equivalent to the circuit shown in FIG. 2A, for example. Here, in the example shown in FIG. 5A, the drain electrodes SD1 have a U-shape in a plan view and are arranged such that the extending direction of the scanning signal lines GL becomes the vertical direction. However, the drain electrodes SD1 is not limited to such configuration and the drain electrodes SD1 may be arranged such that the extending direction of the video signal lines DL becomes the vertical direction. Still further, a planar shape of the drain electrodes SD1 is not limited to a U-shape and may be formed in a linear shape or in a stepped shape.

Further, on the video signal lines DL, pixel electrodes PX are formed by way of a second insulation layer PAS2. The pixel electrodes PX are connected with source electrodes SD2 via through holes TH. Further, in the liquid crystal display panel 1 which adopts the vertical electric field driving method, it is unnecessary to form slits SL in the pixel electrodes PX. Here, the pixel electrode PX is formed such that a portion of the pixel electrode PX overlaps in a plan view, the scanning signal line on a side opposite to the scanning signal line to which a gate of the TFT which is connected via a through hole TH is connected, and a holding capacitance is formed by the scanning signal line, the pixel electrode PX and insulation layers PAS1, PAS2 interposed between the scanning signal line and the pixel electrode PX.

Further, an orientation film ORI1 is formed on the pixel electrodes PX.

On the other hand, with respect to the counter substrate 102, on a surface of the insulation substrate SUB2 formed of a glass substrate or the like, a light blocking film BM which is referred to as a black matrix and color filters CF are formed. The light blocking film BM is formed in a grid pattern to separate the respective pixels by etching a conductive film or an insulation film having optical transmissivity of approximately 0, for example. The color filters CF are formed by etching an insulation film or exposing and developing an insulation film, for example. Further, the color filters CF are formed such that in opening regions of the light blocking film BM, a filter serving for a display of R (red), a filter serving for a display of G (green) and a filter serving for a display of B (blue) are arranged periodically.

Further, on the light blocking film BM and the color filters CF, the counter electrode CT is formed by way of an overcoat layer OC, for example. Further, the orientation film ORI2 is formed on the counter electrode CT.

In this manner, in the liquid crystal display panel 1 which adopts a vertical electric field driving method, by providing the structure equivalent to the circuit constitution shown in FIG. 2A as the structure (arrangement) of the pixel in the display region DA and by driving the liquid crystal display panel 1 by the method explained in conjunction with FIG. 2B, a heat value of the data driver 2 can be reduced thus enhancing display quality. Further, by adopting a common inversion driving for each pixel row, it is possible to easily realize an inversion mode equal to dot inversion driving.

Figure 6A:
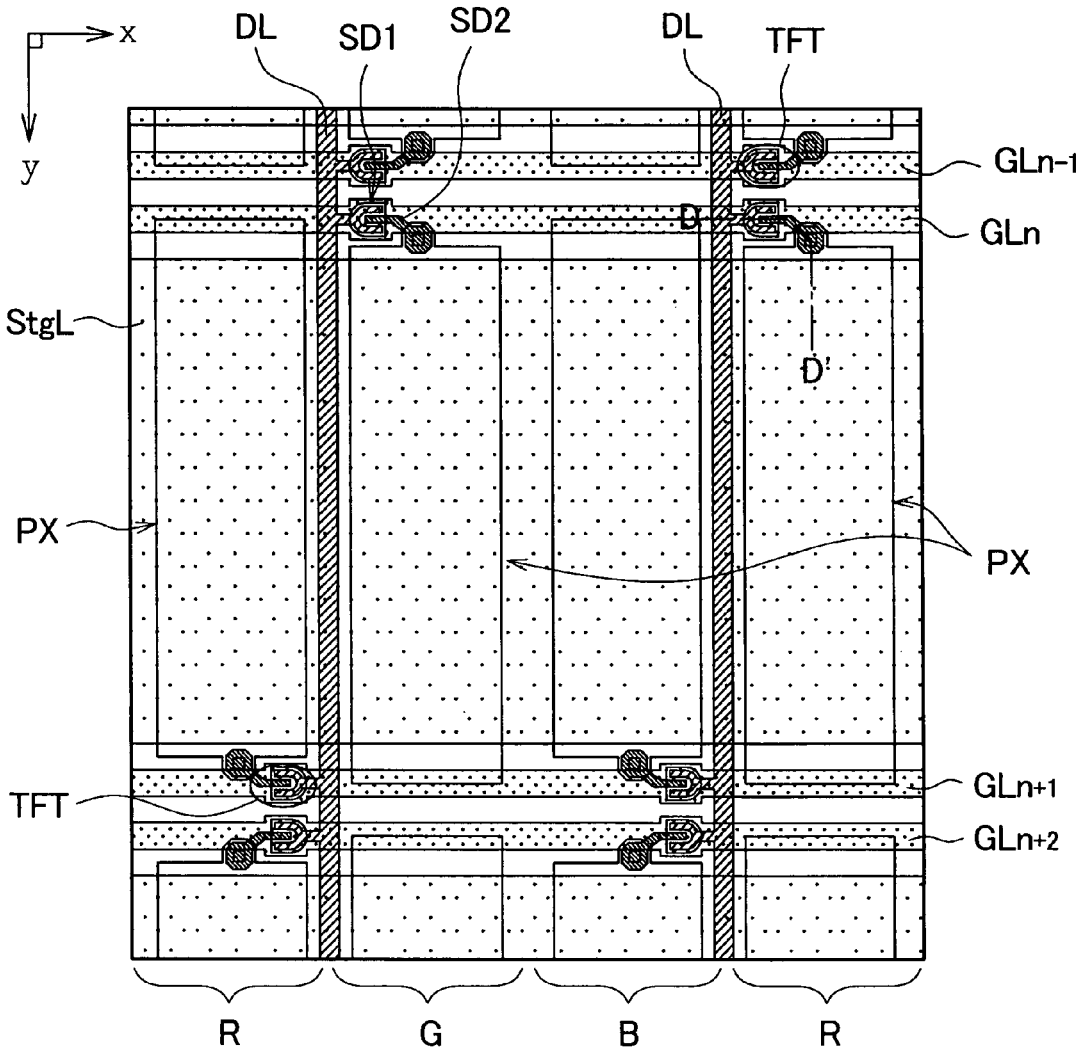
FIG. 6A is a schematic plan view showing a third constitutional example of the TFT substrate of the liquid crystal display panel shown in FIG. 3A and FIG. 3B.
Figure 6B:
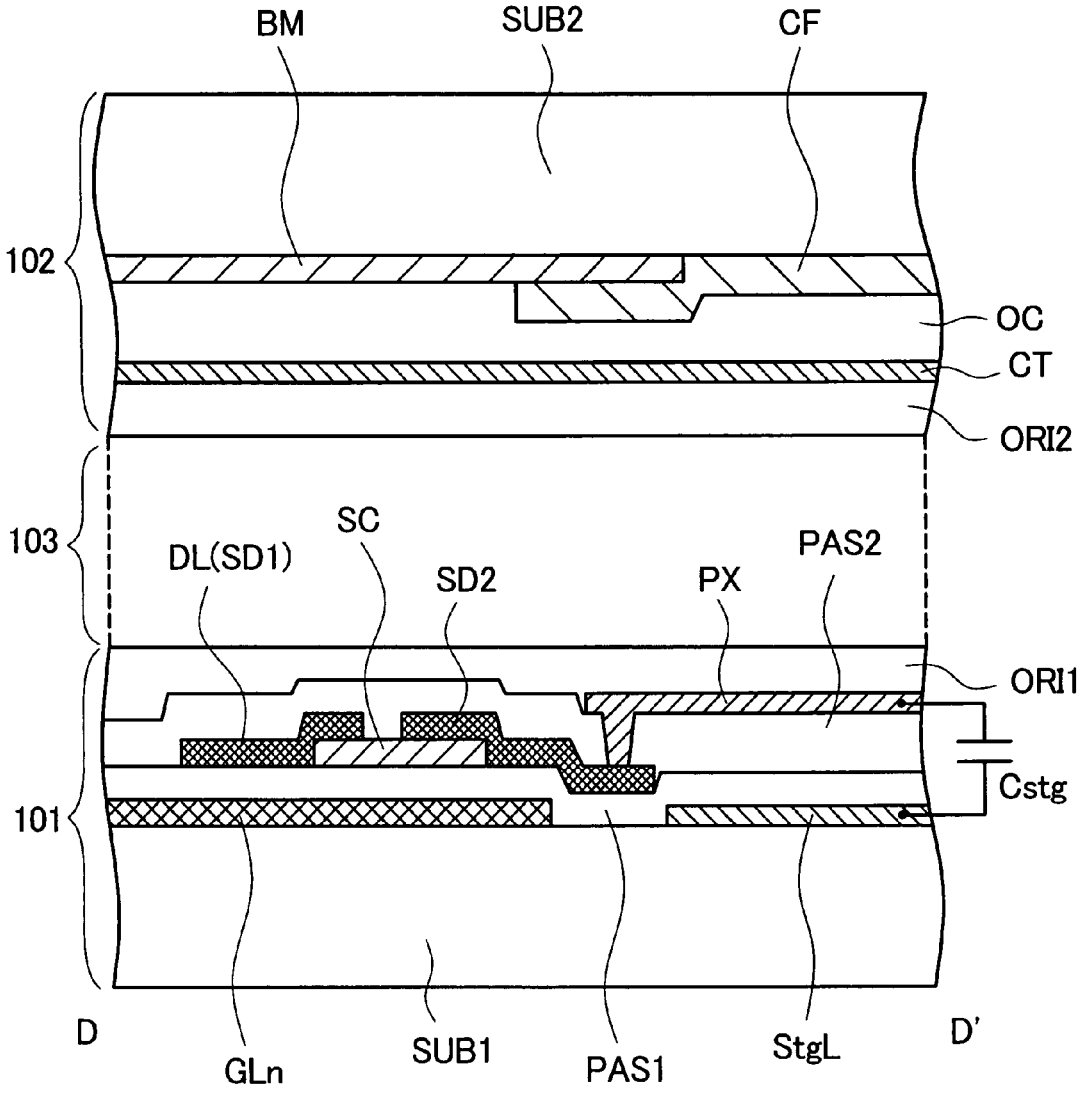
FIG. 6B is a schematic cross-sectional view showing one example of the cross-sectional constitution of the liquid crystal display panel taken along a line D-D' in FIG. 6A.
Figure 7:
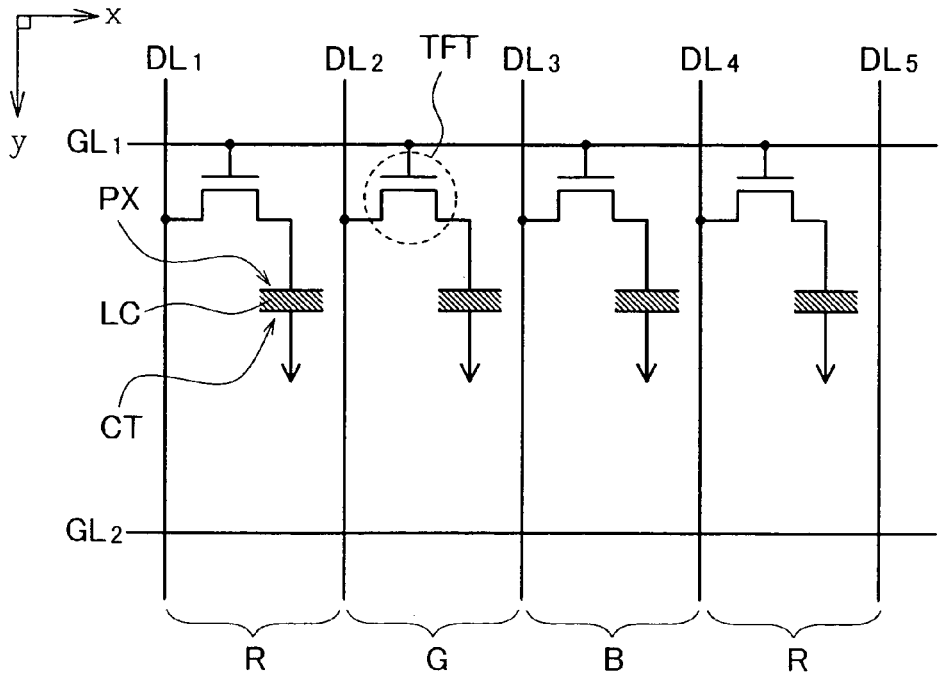
FIG. 7 Prior Art
FIG. 7 is a schematic circuit diagram showing one example of the circuit constitution of a conventional liquid crystal display panel.
Figure 8:
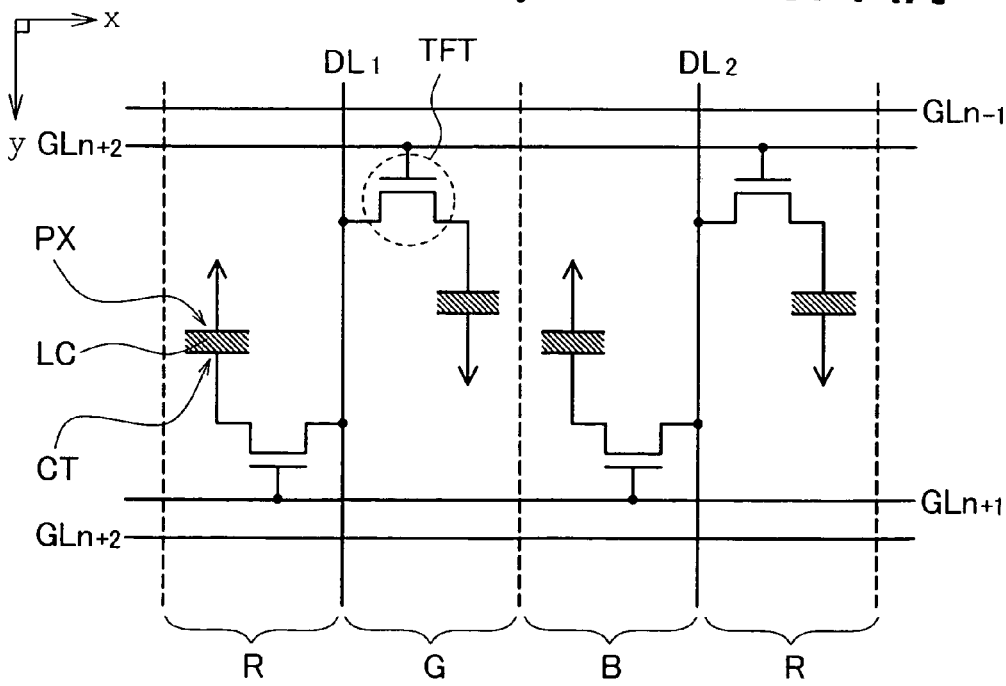
FIG. 8 Prior Art
FIG. 8 is a schematic circuit diagram showing one example of the circuit constitution of a conventional liquid crystal display panel which adopts a double-scanning line method.

FIG. 6A is a schematic plan view showing a third constitutional example of the TFT substrate of the liquid crystal display panel shown in FIG. 3A and FIG. 3B. FIG. 6B is a schematic cross-sectional view showing one example of the cross-sectional constitution of the liquid crystal display panel taken along a line D-D' in FIG. 6A.

When the liquid crystal display panel 1 of this embodiment adopts the vertical electric field driving method, for example, in place of forming the holding capacitance attributed to the scanning signal line, the pixel electrodes PX and the first insulation layer PAS1 interposed between the scanning signal line and the pixel electrode PX as shown in FIG. 5A, conductive layers (holding capacitance lines) different from the scanning signal lines may be formed on the TFT substrate 101. One constitutional example of the liquid crystal display panel 1 which adopts the vertical electric field driving method which forms the holding capacitance lines on the TFT substrate 101 is shown in FIG. 6A and FIG. 6B.

In case of the liquid crystal display panel 1 which adopts the vertical electric field driving method having the holding capacitance lines, with respect to the TFT substrate 101, for example, as shown in FIG. 6A and FIG. 6B, on a surface of the insulation substrate SUB1 formed of a glass substrate or the like, the plurality of scanning signal lines GL and the plurality of holding capacitance lines StgL are formed. The scanning signal lines GL are formed by etching a conductive film made of aluminum or the like, for example, while the holding capacitance lines StgL are formed by etching a conductive film having high optical transmissivity made of ITO or the like, for example. Further, the holding capacitance lines StgL is formed in a strip shape between two scanning signal lines which are arranged close to each other with one pixel row sandwiched therebetween (for example, between scanning signal lines $GL_n$ and $GL_{n+1}$). Further, the respective strip-like holding capacitance lines StgL are electrically connected with each other by a bus line outside the display region DA, for example.

Further, on the scanning signal lines GL and the holding capacitance lines StgL, semiconductor layers SC, video signal lines DL (drain electrodes SD1) and the source electrodes SD2 are formed by way of a first insulation layer PAS1. Also in this case, the drain electrodes SD1 are formed by branching portions of the video signal lines DL. Here, the branching direction is determined equivalent to the circuit shown in FIG. 2A, for example. Here, in the example shown in FIG. 6A, the drain electrodes SD1 have a U-shape in a plan view and are arranged such that the extending direction of the scanning signal lines GL becomes the vertical direction. However, the drain electrodes SD1 are not limited to the above-mentioned configuration and may be arranged such that the extending direction of the video signal lines DL becomes the vertical direction. Still further, a planar shape of the drain electrodes SD1 is not limited to a U-shape and may be formed in a linear shape or in a stepped shape.

Further, on the video signal lines DL or the like, the pixel electrodes PX are formed by way of a second insulation layer PAS2. The pixel electrodes PX are connected with source electrodes SD2 via through holes TH. Here, the pixel electrode PX has a portion which overlaps the holding capacitance line StgL in a plan view, and holding capacitance Cstg is formed by the pixel electrode PX, the holding capacitance line StgL and insulation layers PAS1, PAS2 which are interposed between the pixel electrode PX and the holding capacitance line StgL. Here, by changing a width of the holding capacitance line StgL or a shape of a portion of the holding capacitance line StgL which overlaps the pixel electrode PX in a plan view, a magnitude of the holding capacitance can be easily changed.

Further, an orientation film ORI1 is formed on the pixel electrodes PX.

On the other hand, with respect to the counter substrate 102, on a surface of the insulation substrate SUB2 formed of a glass substrate or the like, a light blocking film BM which is referred to as a black matrix and color filters CF are formed. The light blocking film BM is formed in a grid pattern to separate the respective pixels by etching a conductive film or an insulation film having optical transmissivity of approximately 0, for example. The color filters CF are formed by etching an insulation film or exposing and developing an insulation film, for example. Further, the color filters CF are formed such that in opening regions of the light blocking film BM, a filter serving for a display of R (red), a filter serving for a display of G (green) and a filter serving for a display of B (blue) are arranged periodically.

Further, on the light blocking film BM and the color filters CF, the counter electrode CT is formed by way of an overcoat layer OC, for example. Further, the orientation film ORI2 is formed on the counter electrode CT.

In this manner, in the liquid crystal display panel 1 which adopts a vertical electric field driving method, by providing the structure equivalent to the circuit constitution shown in FIG. 2A as the structure of the TFT substrate 101 and by driving the liquid crystal display panel 1 by the method explained in conjunction with FIG. 2B, a heat value of the data driver 2 can be reduced thus enhancing display quality. Further, by adopting a common inversion driving for each pixel row, it is possible to easily realize an inversion mode equal to the dot inversion driving. Here, when the constitution shown in FIG. 6A and FIG. 6B is adopted, it is desirable to change over the potential of the holding capacitance lines StgL in synchronism with the changeover of the potential of the common voltage Vcom applied to the common electrodes CT.

Here, in this embodiment, as the constitutional example of the liquid crystal display panel 1 which adopts the vertical electric field driving method, the constitution shown in FIG. 5A and FIG. 5B and the constitution shown in FIG. 6A and FIG. 6B are exemplified. However, it is needless to say that the present invention is not limited to the above-mentioned constitutions and is applicable to the constitutions which adopt various vertical electric field driving methods.

Although the present invention has been specifically explained in conjunction with the embodiment heretofore, it is needless to say that the present invention is not limited to the above-mentioned embodiment and various modifications are conceivable without departing from the gist of the present invention.

What is claimed is:

1. A liquid crystal display device comprising:

a display panel which includes a plurality of video signal lines, a plurality of scanning signal lines, and pixels each of which includes a switching element and a pixel electrode and forms a pixel capacitance by the pixel electrode, a liquid crystal material and a common electrode, and has a display region which is constituted by arranging a plurality of pixels in the extending direction of the video signal lines and the extending direction of the scanning signal lines respectively, the display panel being formed of a pair of substrates, the pixel electrodes of the pixels being formed on a first substrate of the pair of substrates and the common electrodes of the pixels being formed on a second substrate of the pair of substrates, the pixel electrodes and the common electrodes being operated based on a vertical electric field method with holding capacitance lines being formed on the pair of substrates;

a first drive circuit which inputs a video signal to the plurality of video signal lines;

a second drive circuit which inputs a scanning signal sequentially to the plurality of scanning signal lines; and a common voltage control circuit which controls a potential of a common voltage inputted to the common electrodes, wherein the plurality of video signal lines is arranged such that one video signal line is allocated to two neighboring pixel electrodes with respect to the plurality of pixel electrodes arranged in a row in the extending direction of the scanning signal lines, the plurality of scanning signal lines is arranged such that two scanning signal lines are arranged between two neighboring pixel electrodes arranged in the extending direction of the video signal lines and, at the same time, two scanning signal lines are arranged to sandwich the plurality of pixel electrodes with respect to the plurality of pixel electrodes arranged in a row in the extending direction of the scanning signal lines, the plurality of pixels which is arranged in a row in the extending direction of the scanning signal lines is configured such that the pixel which connects the switching element thereof to the first scanning signal line out of two scanning signal lines which are arranged to sandwich the pixel electrodes of the plurality of pixels, and the pixel which connects the switching element thereof to the second scanning signal line out of two scanning signal lines are alternately arranged, two neighboring pixels which sandwich one video signal line therebetween are configured such that the switching element of each pixel is connected to one video signal line and, at the same time, a position of the pixel which connects the switching element thereof to the first scanning signal line out of two scanning signal lines and a position of the pixel which connects the switching element thereof to the second scanning signal line out of two scanning signal lines are inverted for every pair of two pixels arranged in the extending direction of the video signal lines, and the common voltage control circuit alternately changes over the potential of the common voltage between a first potential and a second potential higher than the first potential each time the scanning signal line to which the scanning signal is inputted from the second drive circuit is changed, and inputs the common voltage into the common electrodes, and the first drive circuit is configured such that when the common voltage of the first potential is inputted to the common electrode, a video signal of a potential equal to or higher than the first potential is inputted to the first drive circuit, and when the common voltage of the second potential is inputted to the common electrode, a video signal of a potential equal to or lower than the second potential is inputted to the first drive circuit.

2. The liquid crystal display device according to claim 1, wherein the switching element is a TFT (Thin Film Transistor), a gate electrode of the TFT is connected to the scanning signal line, either one of a drain electrode and a source electrode of the TFT is connected to the video signal line, the electrode which is not connected to the video signal line out of the drain electrode and the source electrode of the TFT is connected to the pixel electrode.

3. The liquid crystal display device according to claim 1, wherein the holding capacitance lines are formed in a strip shape between pairs of scanning signal lines arranged proximate to each other with one pixel row sandwiched therebetween.

4. A liquid crystal display device comprising:

a display panel which includes a pair of substrates, and a plurality of video signal lines, a plurality of scanning signal lines, and switching elements which are formed on respective pixel regions at an intersecting position of the video signal lines and the scanning signal lines on one of substrates, a pixel electrode and a common electrode being respectively formed on each pixel region, the pixel electrodes of the pixel regions being formed on a first substrate of the pair of substrates and the common electrodes of the pixel regions being formed on a second substrate of the pair of substrates, the pixel electrodes and the common electrodes being operated based on a vertical electric field method with holding capacitance lines being formed on the pair of substrates;

a first drive circuit which inputs a video signal to the plurality of video signal lines;

a second drive circuit which inputs a scanning signal sequentially to a plurality of scanning signal lines; and a common voltage control circuit which controls a potential of a common voltage inputted to the common electrodes, wherein the plurality of video signal lines is arranged such that one video signal line is allocated to two neighboring pixel electrodes with respect to the plurality of pixel electrodes arranged in a row in the extending direction of the scanning signal lines, the plurality of scanning signal lines is arranged such that two scanning signal lines are arranged between two neighboring pixel electrodes arranged in the extending direction of the video signal lines, the common voltage control circuit alternately changes over the potential of the common voltage between a first potential and a second potential higher than the first potential each time the scanning signal line to which the scanning signal is inputted from the second drive circuit is changed, and inputs the common voltage into the common electrodes, and the first drive circuit is configured such that when the common voltage of the first potential is inputted to the common electrode, a video signal of a potential equal to or higher than the first potential is inputted to the first drive circuit, and when the common voltage of the second potential is inputted to the common electrode, a video signal of a potential equal to or lower than the second potential is inputted to the first drive circuit.

5. The liquid crystal display device according to claim 4, wherein the switching element is a TFT (Thin Film Transistor), a gate electrode of the TFT is connected to the scanning signal line, either one of a drain electrode and a source electrode of the TFT is connected to the video signal line, the electrode which is not connected to the video signal line out of the drain electrode and the source electrode of the TFT is connected to the pixel electrode.

6. The liquid crystal display device according to claim 4, wherein the holding capacitance lines are formed in a strip shape between pairs of scanning signal lines arranged proximate to each other with one pixel row sandwiched therebetween.

* * * * *